United States Patent [19]

Lunenschloss et al.

[11] Patent Number: 4,905,345

[45] Date of Patent: Mar. 6, 1990

[54] TRACK SYSTEM FOR SLIDING DOOR

[75] Inventors: John T. Lunenschloss; Henry M. Ebbott, both of Madison; Raymond A. Beckeman, McFarland; Glen M. Gregerson, Janesville, all of Wis.

[73] Assignee: Air-Lec Industries, Inc., Madison, Wis.

[21] Appl. No.: 320,973

[22] Filed: Mar. 9, 1989

[51] Int. Cl.[4] ..... F05D 15/00

[52] U.S. Cl. ..... 16/94 R; 16/95 R; 16/96 R

[58] Field of Search ..... 16/96 R, 87 R, 94 R, 16/95 R; 104/106, 110, 111

[56] References Cited

U.S. PATENT DOCUMENTS

| | | | |
|---|---|---|---|
| 837,819 | 12/1906 | Ferris | 16/94 R |
| 1,156,419 | 10/1915 | McPherson . | |
| 1,480,641 | 1/1924 | Tetzlaff . | |
| 2,131,784 | 10/1938 | Nock | 16/96 R |
| 2,242,329 | 5/1941 | Saulson | 16/96 R |
| 3,473,266 | 10/1969 | Miller . | |
| 3,855,732 | 12/1974 | Sheaf | 16/96 R |
| 3,925,933 | 12/1975 | Reuter | 16/96 R |
| 4,073,034 | 2/1978 | Martens | 16/87 B |
| 4,694,531 | 9/1987 | Foy | 16/87.4 R |

OTHER PUBLICATIONS

Advertisement entitled Mark III shown in *Frozen Food Age,* Jan. 1988, distributed by Jamison Door Company, Hagerstown, Md.

Advertisement: brochure entitled "Lock-Joint" No's. 888-13 and 1098 Door Hangers distributed by Richards-Wilcox, Aurora, Ill.

Advertisement brochure entitled "Lock-Joint" Trucks (less aprons) distributed by Richards-Wilcox, Aurora, Ill.

*Primary Examiner*—Richard K. Seidel
*Assistant Examiner*—Carmine Cuda
*Attorney, Agent, or Firm*—Lathrop & Clark

[57] ABSTRACT

A track system on which a sliding door may be hung includes a channel having a bottom wall and two substantially parallel side walls which extend upwardly from the bottom wall, at least two tube sections which lie coaxially on the bottom wall of the channel, and at least one spacer between adjacent tube sections. The tube sections each have a select outside diameter, and at least one hollow end with a select inside diameter. Each spacer includes a central cylindrical portion with an outside diameter equal to the select outside diameter of the tube sections, and two cylindrical insert portions which each have an outside diameter substantially equal to the inside diameter of the tube section hollow ends. Each cylindrical insert portion extends axially from one end of the central cylindrical portion into the hollow end of one of the tube sections to maintain the tube section in position on the channel bottom wall. The outside surfaces of the tube sections and central cylindrical portions together form a substantially smooth, continuous cylindrical surface over which a roller may rotate to allow its connected door to move back and forth. The track system is mounted with L-brackets which each include a horizontal leg which underlies the channel, and a vertical leg which is connected to the wall forming the doorway.

17 Claims, 2 Drawing Sheets

TRACK SYSTEM FOR SLIDING DOOR

BACKGROUND OF THE INVENTION

1. Field of the Invention

The present invention relates to sliding doors, and more specifically to improvements in the track system on which a sliding door is hung.

2. The Description of the Related Art

Various types of track systems from which sliding doors hang and door guides over which sliding doors move currently exist. For example, U.S. Pat. No. 1,156,419 to McPherson, 2,131,784 to Nock, 3,473,266 to Miller and 3,925,933 to Reuter all disclose track systems on which sliding doors may be hung. Each of these track systems include a rail having an arcuate surface on which a grooved roller turns to allow the door to slide back and forth. Some of these track systems appear to be fairly complicated in their structure, and generally the rail and supporting structure appear to be continuous, unitary structures throughout their entire length.

A door guide over which a hangar door may slide is disclosed in U.S. Pat. No. 2,242,329 to Saulson. The door guide includes a tubular rail which is welded to the sidewalls of a channel base which is supported along its entire length by the concrete foundation in which it is embedded. The tubular rail is hollow which allows hot brine to be pumped therethrough to prevent the temperature of the rail from going below the freezing point. The tubular rail and channel base each appear to be formed of a single unitary piece of material which therefore may be fairly lengthy.

SUMMARY OF THE INVENTION

The present invention is summarized in that a track on which a sliding door is hung, includes a channel having a bottom wall and two substantially parallel side walls which extend upwardly from the bottom wall, at least two tube sections which lie coaxially on the bottom wall of the channel, and at least one spacer which is positioned substantially between adjacent tube sections to join the tube sections. Each of the tube sections has a select outside diameter, and at least one hollow end with a select inside diameter.

Each spacer includes a central cylindrical portion with an outside diameter equal to the select outside diameter of the tube sections, and two cylindrical insert portions which each have an outside diameter substantially equal to the inside diameter of the tube section hollow ends. Each cylindrical insert portion on a spacer extends axially from one of two ends of the central cylindrical portion of the spacer into the hollow end of one of the tube sections, so that the tube section end abuts against the corresponding end of the central cylindrical portion. The outside surfaces of the tube sections and cylindrical portions of the spacers together form a substantially smooth, continuous cylindrical surface.

The channel preferably is formed of a plurality of channel sections which are positioned end-to-end, with the ends of adjacent channel sections located below or nearly below a spacer. The channel sections, tube sections and spacers are mounted on L-brackets which are used to connect the track system to the wall which forms a doorway. These components of the track system preferably are held together by a cap screw which extends upwardly through the bracket, channel and into the spacer. Preferably the dimensions of the track will be chosen so that both sidewalls of the channel actually abut against and therefore stabilize the tube sections and central cylindrical portions of the spacers.

The components of the track system may be manufactured in a kit form, with the channel sections and tube sections each being of length consistent with like parts. The kit may be assembled to form a track system of practically any length. The track system is easy to assemble and once assembled, is quite simple in structure. Essentially only four simple components—the tube sections, channel sections, the spacers, and brackets are necessary to the construction of the track system.

A primary object of the invention is to provide a track system on which a sliding door is hung, which may be manufactured as a kit, and which can be used to make a track system of any length by piecing together the individual components.

A further object of the present invention is to provide a track system kit which includes components which are easily broken down into short lengths which may be shipped by mail or U.P.S., and which is easily assembled and installed at the work site to form a track system of any desired length.

Another object of the present invention is to provide a track system on which a sliding door is hung, and which is formed essentially of four simple components—channel sections, tube sections, spacers, and brackets.

An additional object of the present invention is to provide a track system on which a sliding door is hung, which is easily assembled and disassembled in sections from interchangeable components.

Other objects, features and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
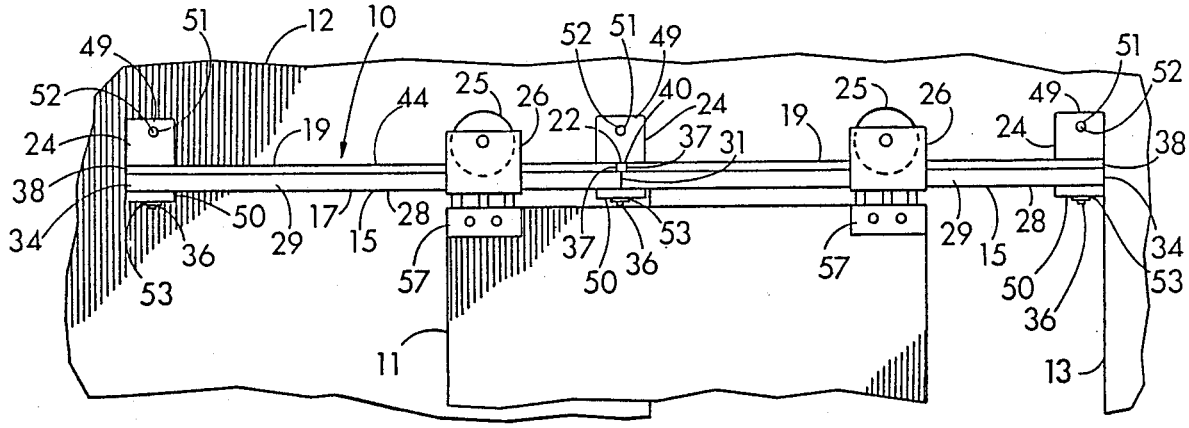
FIG. 1 is a front elevational view of a track system on which a sliding door is hung, in accordance with the invention.
Figure 2:
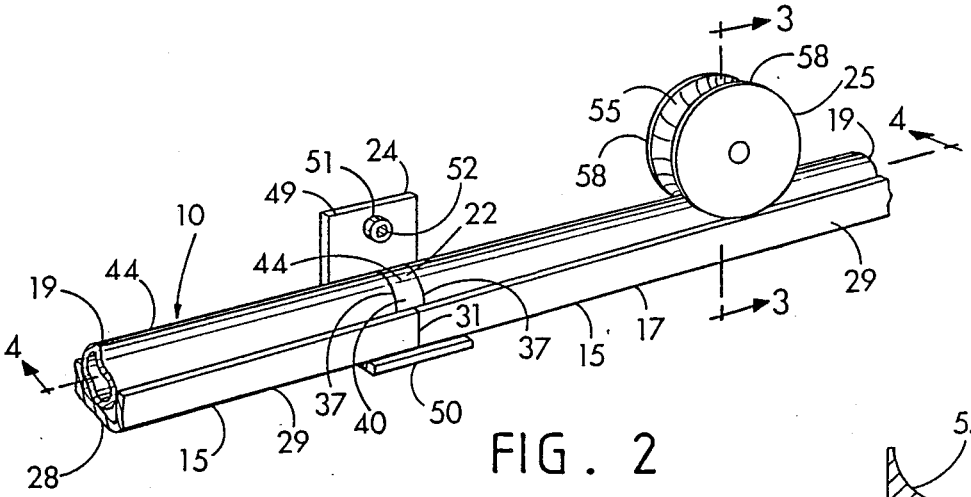
FIG. 2 is a perspective view of a portion of the track system of FIG. 1, showing the roller without its housing.

Referring more particularly to the drawings, wherein like numbers refer to substantially similar parts, FIG. 1 shows a track system 10 on which a sliding door 11 is hung. The track system 10 as shown is attached to a wall 12 above the doorway 13 so that the sliding door 11 can move back and forth on the track system 10. FIG. 2 shows a perspective view of a portion of the track system 10. As shown in FIGS. 1–4, the track system 10 includes two channel sections 15, which when placed together end-to-end to form a channel 17, two tube sections 19, a spacer 22, three L-brackets 24 and two rollers 25 with their respective housings 26 which are each attached to the door 11. The channel sections 15 are about equal in length and the tube sections 19 are slightly shorter in length than the channel sections 15.

The track system is designed to be formed of components which are fairly short, so that the track system can be broken down and shipped by mail or U.P.S. to the customer. The track system is assembled and installed easily at the work site to be of any desired length. The track system 10 shown in FIGS. 1–4, which includes a fairly limited number of components, therefore is exemplary.

Figure 3:
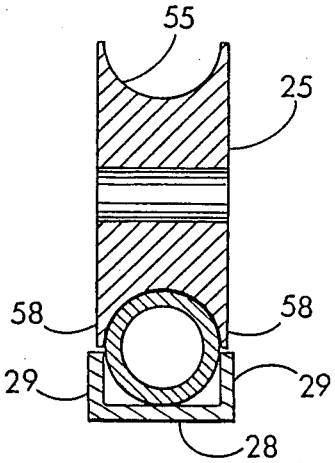
FIG. 3 is a cross-sectional view taken along section line 3—3 of FIG. 2.
Figure 4:
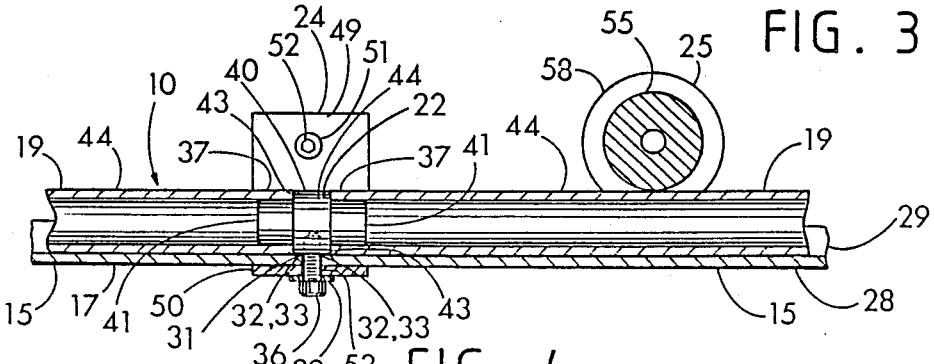
FIG. 4 is a longitudinal section view taken along section line 4—4 of FIG. 2, except that the spacer is shown in full view.

As shown most clearly in FIGS. 2–3, each channel section 15 of the track system 10 includes a bottom wall 28 and two substantially parallel side walls 29 which extend upwardly from the bottom wall 28. Thus the bottom walls 28 of the channel sections 15 together form the bottom wall of the channel 17, and the side walls 29 of the channel sections 15 form the side walls of the channel 17. The numbers 28 and 29 therefore will be used as well to designate respectively the bottom wall and side walls of the channel 17. Preferably the channel sections 15 are formed with 1 inch by ½ inch steel channel. As is best shown in FIG. 4, the channel section ends 31 adjacent to the spacer 22 each form a notch 32 such that the two channel section ends 31 together form a hole 33 when the channel sections 15 are placed end-to-end. Additionally, holes (not shown) may be formed near the channel section ends 34 which are not adjacent to other channel sections 15. The holes 33 allow cap screws 36 with washers 39 to pass through the channel 17 into the spacer 22 or the tube sections 19.

The two tube sections 19 are of generally equal length and may lie coaxially on the bottom wall 28 of the channel 17 substantially between the two side walls 29. The tube sections 19 have a select outside diameter and a select inside diameter. Preferably the tube sections 19 are formed of steel tubing with a ¾ inch outside diameter and about a ½ inch inside diameter. As shown in FIGS. 1 and 3, the tube sections 19 therefore extend upwardly beyond the sidewalls 29 for some distance. It is preferred that the dimensions of the tube sections 19 and channel sections 15 be selected such that the tube sections 19 actually abut against both sidewalls 29 for increased stability. If for some reason it is desired that the tube sections 19 be solid, the ends 37 of the sections 19 which are intended to be joined to a spacer 22 should be bored to form a hollow end 37 with a select inside diameter, preferably about ½ inch. Of course, if the sections 19 are hollow with a select inside diameter, the ends 37 of the tube sections will be hollow ends 37 also having the select inside diameter. The outside ends 38 of the tube sections 19 may be joined to a spacer 22.

The spacer 22 which is located substantially between the two tube sections 19 includes a central portion 40, which is preferably cylindrical, with a ¾ inch outside diameter, and two cylindrical insert portions 41 which each have an outside diameter about ½ inch so that the cylindrical insert portions 41 fit into the hollow ends 37 of the tube sections 19. Although the dimensions might differ, the outside diameter of the central cylindrical portion 40 should be equal to the select outside diameter of the tube sections 19, and the outside diameter of the cylindrical insert portions 41 should be about equal to the inside diameter of the tube section hollow ends 37 to fit snugly therein. Each cylindrical insert portion 41 extends concentrically and axially from one of the two ends 43 of the central cylindrical portion 40 into the hollow end 37 of one of the tube sections 19, such that the tube section end 37 abuts against the corresponding end 43 of the central cylindrical portion 40. Thus the outside surfaces of the tube sections 19 and the central cylindrical portions 40 of the spacers 22 together form a substantially smooth, continuous cylindrical surface 44 as is best shown in FIGS. 2 and 4.

Figure 5:
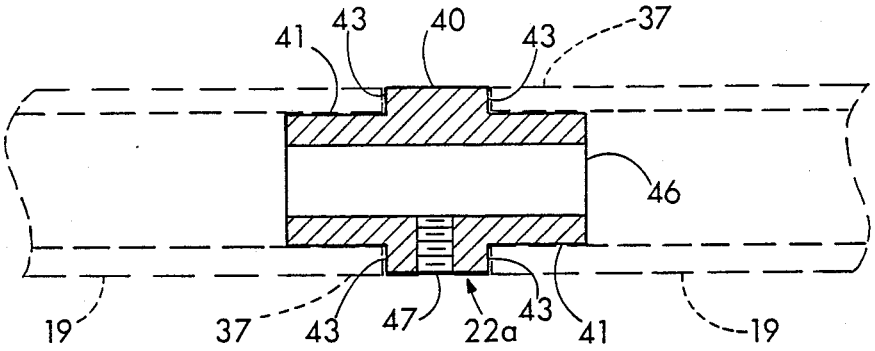
FIG. 5 is a longitudinal section view of a spacer having an axial hole therethrough.
Figure 6:
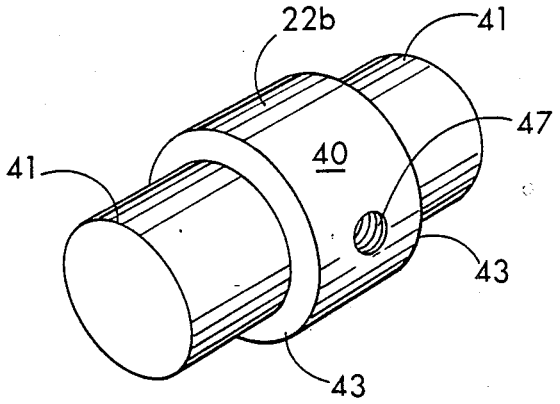
FIG. 6 is a perspective view of a spacer which is substantially solid.

The spacer 22 may have an axial hole therethrough which allows communication between adjacent hollow tube sections 19 as shown at **22*a* of FIG. 5, or may be solid as shown at 22*b* of FIG. 6. In either case, the spacer 22*a* or 22*b* has a radially directed threaded hole 47 into which the cap screw 36 screws to maintain the spacer 22, tube sections 19, channel sections 15 in connection with the inner L-bracket 24 shown in FIGS. 1, 2 and 4. If both the tube sections 19 and the spacer 22 are hollow, a heating element (not shown) can be extended through and between tube sections 19 to heat the spacers 22 and tube sections 19 to thereby prevent icing on the substantially smooth, continuous cylindrical surface 44**.

Figure 7:
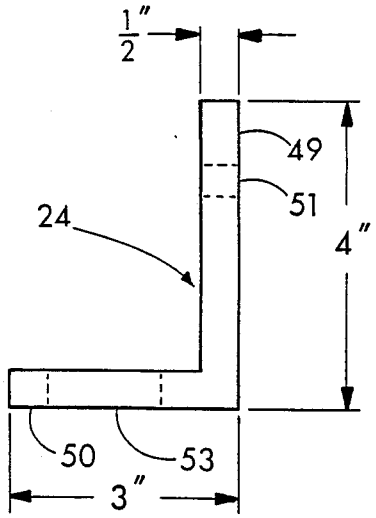
FIG. 7 is a side elevational view of an L-bracket.
Figure 8:
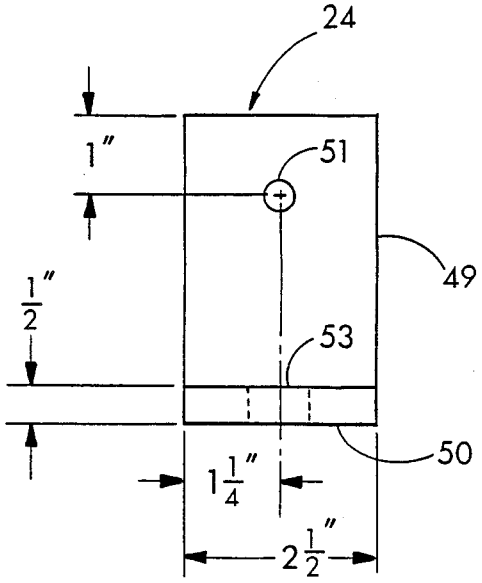
FIG. 8 is a front elevational view of the L-bracket of FIG. 7.

As shown in FIGS. 7 and 8, each L-bracket 24 includes a vertical leg 49, and a horizontal leg 50 which extends outwardly from the vertical leg 49. The brackets 24 preferably have a width of about 2½ inches, and a thickness of about ½ inch. The vertical leg 49 has a length of about 4 inches and the horizontal leg 50 has a length of about 3 inches. The vertical leg 49 preferably has a hole 51 through which a screw or bolt 52 may be placed as shown in FIG. 1 to mount the L-bracket 24 to the wall 12 near the doorway 13. The horizontal leg 50 of each L-bracket 24 has a centrally located elongated or oval opening 53 preferably having a major axis measuring 23/32 inch and a minor axis measuring 13/32 inch as shown in FIGS. 7–8. The cap screws 36 preferably are ⅜ inch by 1 inch screws. The larger major diameter of the oval opening 53 allows for adjustment in the positioning of the channel 17, tube sections 19 and spacers 22 over the bracket horizontal leg 50 when the cap screw 36 is loosened. The channel 17, tube sections 19 and spacers 22 may be moved closer or further away from the wall 12 as allowed by the oval opening 53 to thereby adjust the position of the door 11 in relation to the doorway 13.

Each of the two rollers 25 as shown in FIGS. 1–4 have an outer circumferential surface defining a concave groove 55 therearound with about a nominal ¾ inch diameter so that each roller, when rotating over the tube sections 19 and spacers 22, smoothly rides over the continuous cylindrical surface 44. The groove 55 should have a radius of curvature substantially equal to, or slightly larger than the radius of a cross-section of the tube sections 19 so that the groove 55 substantially conforms to the shape of the smooth continuous cylindrical surface 44 formed by the cylindrical outside surfaces of the spacers 22 and tube sections 19. Each roller 25 is rotatably mounted within a housing 26 which is connected to the door 11 by way of the saddles 57. As shown in FIG. 3, each roller 25 has rims 58 which extend partially around the tube sections 19, and above the channel sidewalls 29. The rollers 25 are preferably formed of structural plastic. The housings 26 and the saddles 57 are preferably formed from metal. Although the housings 26 shown in FIG. 1 only have a single roller 25, they may have two or even more rollers 25.

The tube sections 19 and spacers 22 are secured to the bottom wall 28 of the channel 17 by the cap screw 36 which extends through a hole 33 formed by the two notches 32 in the channel section ends 31 into the threaded hole 47 in the spacer 22 to hold the spacer 22 and its adjacent tube sections 19 within the channel 17. Similarly, the channel 17 is secured near or preferably over the doorway 13 by the L-brackets 24 which can be connected by their vertical legs 49 over the doorway 13. At the inner bracket 24, the cap screw 36 extends through the oval opening 53 in the bracket horizontal leg 50, through the hole 33 formed by the two notches 32 and into the threaded hole 47 in the spacer 22. The central cylindrical portion 40 of the spacer 22 thereby presses down against the two channel sections 15 to hold them to the inner L-bracket 24 which is connected to the wall 12. When the cap screw 36 is tightened, pressure exerted by the central cylindrical portion 40 of the spacer 22 on the adjacent channel section ends 31 also functions to hold the two adjacent ends 31 of the channel sections 15 together. The cylindrical insert portions 41 of the spacer 22 maintain the tube sections 19 in position against the bottom walls 28 of the channel sections 15. Thus the cap screw 36 when tightened causes the adjacent spacer 22, tube sections 19, channel sections 15, and bracket 24 to all be held together.

Although the exemplary preferred track system 10 shown in FIGS. 1, 2 and 4 includes two channel sections 15, two tube sections 19, one spacer 22 therebetween, and one inner L-bracket 24, track systems may be designed which include a larger number of each of these components 15, 19, 22, and 24. If the tube sections 19 and channel sections 15 are of specific length, any number of the tube sections 19 and channel sections 15 may be connected together with the spacers 22 and L-brackets 24 therebetween to form a track system of almost any length. In fact, the components 15, 19, 22, and 24 of the track system may be manufactured and sold as a kit, which also might include the rollers 25, housings 26 and saddles 57. Once the track system is assembled as shown, the cap screws 36 will extend up through the oval opening 53 in each L-bracket 24 and through a hole 33 in the channel 17. The holes 33 may be formed by the notches 32 in the adjacent channel section ends 31, or they might be formed in entirety in the channel sections 15. At locations between tube sections 19 where spacers 22 are located, the cap screw 36 will extend up into a threaded hole 47 in the spacer 22. At the ends of the track system, the cap screw may extend up through the oval opening 53 in the L-bracket 24, through a hole (not shown) in the channel 17 into a threaded hole (not shown) in a spacer **22*a* or 22*b***.

Although in the track system 10 shown in FIGS. 1, 2 and 4, the channel section ends 31 each have a notch 32, which when the channel sections 15 are placed end-to-end form a hole 33, alternatively the channel section ends 31 might be shifted a little to the left or to the right below the spacer 22 so that an entire hole 33 is formed through one of the channel sections 15 just inside its end 31. In another alternative, the channel sections 15 might be welded to the L-brackets 24, and the spacers 22 welded to the bottom wall 28 of the channel 17. Other conventional means may be used for fastening the components 15, 19, 22, and 24 together to assemble the track system 10.

The track system 10 includes only four basic simple components—the channel sections 15, tube sections 19, spacers 22, and L-brackets 24. The track system may be manufactured as a kit which can be used to make a track system of any desired length. The simplicity and interchangeability of the basic components 15, 19, 22 and 24 allow for easy assembly and disassembly of the track system.

It is to be understood that the present invention is not limited to the particular arrangement and embodiments of parts disclosed and illustrated herein, nor to the material specified, but embraces all such modified forms thereof as come within the scope of the following claims.

What is claimed is:

1. A track system on which a sliding door is hung, comprising:

(a) a channel having a bottom wall and two substantially parallel sidewalls which extend upwardly from the bottom wall;

(b) at least two tube sections which lie coaxially on the bottom wall of the channel, the tube sections having a select outside diameter, and at least one hollow end with a select inside diameter; and (c) at least one spacer which each includes a central cylindrical portion with an outside diameter substantially equal to the select outside diameter of the tube sections, and two cylindrical insert portions which each have an outside diameter substantially equal to the inside diameter of the tube section hollow ends and which each extend axially from one of two ends of the central cylindrical portion into the hollow end of one of the tube sections, such that the tube section end abuts against the corresponding end of the central cylindrical portion, and outside surfaces of the tube sections and central cylindrical portions together form a substantially smooth, continuous cylindrical surface.

2. The track system specified in claim 1 further including at least one roller including an outer circumferential surface defining a concave groove with a radius of curvature at least equal to a radius of a cross-section of the continuous cylindrical surface so that the roller when rotating rides over the smooth continuous cylindrical surface; and a housing in which at least one roller is rotatably mounted, the housing being connected to the sliding door to support the door.

3. The track system specified in claim 1 further including means for securing the tube sections and spacers to the bottom wall of the channel.

4. The track system specified in claim 3 wherein the central cylindrical portion of each spacer has a radially directed threaded hole; the channel has a hole coaxial with each threaded hole; and the tube sections and spacers securing means includes at least one cap screw which extends through one hole into one threaded hole to hold the corresponding spacer and its adjacent tube sections to the bottom wall of the channel.

5. The track system specified in claim 1 further including means for securing the channel near a doorway.

6. The track system specified in claim 5 wherein the central cylindrical portion of each spacer has a radially directed threaded hole; the channel has at least one hole which is coaxial with one threaded hole; and the channel securing means includes at least one bracket including a vertical leg which can be connected near the doorway, and a horizontal leg which extends outwardly from the vertical leg to adjacently underlie the channel bottom wall, the horizontal leg having an opening which is coaxial with the hole of the channel; and at least one cap screw which extends through one horizontal leg opening and one hole into one spacer threaded hole to secure the channel near the doorway.

7. The track system specified in claim 6 wherein the channel comprises at least two channel sections positioned end to end, adjacent ends of the channel sections each having a notch forming about one-half of the hole through which the screw passes, so that the channel section ends lie pressed between the spacer and horizontal leg such that the channel section ends are thereby held together.

8. The track system specified in claim 1 wherein the channel comprises at least two channel sections positioned end to end, and the track system further includes means for holding adjacent ends of the channel sections together.

9. The track system specified in claim 8 wherein each spacer has a radially directed threaded hole; and at least one end of each channel section has a notch so that when channel section ends with notches are placed together, the notches together form a hole through the channels; and the adjacent channel ends holding means includes at least one cap screw which extends through one hole into one threaded hole to hold the spacer to the bottom walls of the adjacent channel sections, thereby holding the two adjacent ends of the channel sections together.

10. The track system specified in claim 1 wherein the tube sections are hollow throughout their length, and the spacers have an axial hole allowing communication between adjacent hollow tube sections.

11. The track system specified in claim 10 further including a heating element which extends through and between adjacent tube sections to heat the spacer and tube sections.

12. The track system specified in claim 1 wherein the tube sections and the central cylindrical portions of the spacers abut against the sidewalls of the channel.

13. A track system kit which can be used for hanging a sliding door, comprising:

(a) at least two channel sections which each include a bottom wall and two substantially parallel sidewalls which extend upwardly from the bottom wall and which when placed end-to-end form a channel;

(b) at least two tube sections which each have a select outside diameter such that said tube sections can be positioned on the bottom walls of the channel sections, and at least one hollow end with a select inside diameter;

(c) at least one spacer which each includes a central cylindrical portion with an outside diameter equal to the select outside diameter of the tube sections, and two cylindrical insert portions which each have an outside diameter substantially equal to the inside diameter of the tube section hollow ends and which each extends axially from one of two ends of the central cylindrical portion and can be inserted into one hollow end of said tube sections, so that the tube section end abuts against the corresponding end of the central cylindrical portion, and outside surfaces of the tube sections and central cylindrical portions together form a substantially smooth, continuous cylindrical surface; and (d) at least one bracket including a vertical leg which can be connected above a doorway, and a horizontal leg which extends outwardly from the vertical leg so that when said kit is assembled, the horizontal leg will adjacently underlie the channel bottom wall.

14. The track system kit specified in claim 13 further including:

(a) means for securing the tube sections and spacers to the bottom wall of the channel; and (b) means for securing the channel sections together and to the bracket.

15. The track system kit specified in claim 14 wherein the central cylindrical portion of each spacer has a radially directed threaded hole; at least one end of each channel section has a notch such that two channel sections when placed end-to-end can form a hole; the horizontal leg of at least one bracket has an opening; and the tube sections and spacers securing means and the channel sections securing means include at least one cap screw each of which, when the corresponding spacer threaded holes, holes, and horizontal leg openings are aligned, can be placed and tightened to extend therethrough into the spacer to cause the spacer and adjacent tube sections, adjacent channel sections, and bracket to be held together.

16. The track system kit specified in claim 13 further including at least one roller including an outer circumferential surface defining a concave groove with a radius of curvature at least equal to a radius of a cross-section of the continuous cylindrical surface so that the roller can by rotation ride over the smooth continuous surface; and a housing in which the roller can be rotatably mounted, said housing being connectable to the sliding door to support the door when the kit is assembled.

17. The track system kit specified in claim 13 wherein the tube sections, spacers and channel sections are dimensioned such that the tube sections and central cylindrical portions of the spacers abut against the sidewalls of the channel sections when they lie within the channel sections in abutting relation with the bottom walls of the channel sections.

* * * * *